US008584903B2

(12) United States Patent
DeJonge

(10) Patent No.: US 8,584,903 B2
(45) Date of Patent: Nov. 19, 2013

(54) CHILD RESISTANT CONTAINER WITH INVERTING CAP BOTTOM LIFT FOR VERTICAL NOZZLE PUSH CONTAINER

(76) Inventor: Stuart W. DeJonge, Deland, FL (US)

( * ) Notice: Subject to any disclaimer, the term of this patent is extended or adjusted under 35 U.S.C. 154(b) by 99 days.

(21) Appl. No.: 13/506,378

(22) Filed: Apr. 16, 2012

(65) Prior Publication Data

US 2013/0270298 A1 Oct. 17, 2013

(51) Int. Cl.
*B67B 1/00* (2006.01)

(52) U.S. Cl.
USPC ..... 222/153.13; 222/321.6

(58) Field of Classification Search
USPC ..... 222/153.13, 153.14, 153.09, 153.1, 222/182, 402.11–402.13, 321.6, 153.01, 222/153.02; 215/224, 226–228, 211, 205
See application file for complete search history.

(56) References Cited

U.S. PATENT DOCUMENTS

| | | | | |
|---|---|---|---|---|
| 3,831,804 | A | 8/1974 | Focht | |
| 4,325,497 | A | 4/1982 | Ewald | |
| 4,333,589 | A | 6/1982 | Bush | |
| 4,555,035 | A | 11/1985 | Davis | |
| 4,854,459 | A | 8/1989 | DeJonge | |
| 5,381,912 | A | 1/1995 | Walker et al. | |
| 5,509,550 | A | 4/1996 | DeJonge | |
| 5,732,836 | A | 3/1998 | Barker et al. | |
| 5,749,484 | A | 5/1998 | Trout | |
| 6,029,835 | A | 2/2000 | DeJonge | |
| 6,032,811 | A | 3/2000 | Marconi | |
| 6,880,729 | B2 | 4/2005 | Stull et al. | |
| 6,929,154 | B2 * | 8/2005 | Grey et al. | 222/153.03 |
| 6,964,336 | B2 | 11/2005 | Harrold | |
| 7,757,901 | B2 * | 7/2010 | Welp | 222/321.6 |
| 7,845,346 | B2 * | 12/2010 | Langford et al. | 128/200.23 |
| 7,971,738 | B2 * | 7/2011 | DeJonge | 215/206 |
| 7,984,830 | B2 * | 7/2011 | Stradella | 222/153.13 |
| 8,360,281 | B2 * | 1/2013 | DeJonge | 222/182 |
| 2002/0066752 | A1 * | 6/2002 | Ritsche et al. | 222/153.13 |

* cited by examiner

*Primary Examiner* — Lien Ngo
(74) *Attorney, Agent, or Firm* — Kenneth P. Glynn, Esq.; Deirdra M. Meagher, Esq.

(57) ABSTRACT

A child resistant container with inverting cap bottom lift features has a container main body adapted to receive a sprayer container with a vertical spray nozzle top-positioned spray actuator, and has at least one lift rod slot on its bottom; an inner cap for permanent connection to the open top of the container after a spray container is placed therein; and an outer cap with at least one downwardly projecting lift rod. The inner cap has a spray actuator orifice large enough to permit a vertical nozzle of a spray container to pass therethrough and small enough to prevent a spray container spray actuator from passing therethrough. A user removes the outer cap, inverts it and pushes up through the bottom to raise up the spray container nozzle and to push on the spray actuator to dispense.

20 Claims, 10 Drawing Sheets

CHILD RESISTANT CONTAINER WITH INVERTING CAP BOTTOM LIFT FOR VERTICAL NOZZLE PUSH CONTAINER

BACKGROUND OF INVENTION a. Field of Invention

The field of the invention is child resistant containers with safety caps developed to inhibit dispensing of potentially harmful or restricted contents by children. The invention relates generally to a child resistant container that is adapted to receive and to lock in a sprayer container with a top-positioned spay actuator. The device has a container body, an inner cap and an outer cap. The outer cap may be removed and inverted and then used to push up a spray container for user spray activation. The device is particularly beneficial as a retrofit child resistant container for potentially dangerous spray products to children; e.g., medicines, oven cleaners, etc.

b. Description of Related Art

The following patents are representative of the field pertaining to the present invention:

U.S. Pat. No. 6,964,336 B2 to John E. Harrold describes a child resistant container for stick applicators is described that is directed to keeping children out of the container prior to use, and to secure the container and its contents after use. In one embodiment, the container includes a combination cap and plug. The plug has a first and second position relative to the cap, and the cap is not removable when the plug is in its first position and pulled, and is removable when the plug is in its second position and pulled. In another embodiment, a plug cap cannot be removed from the container unless a bottom cap is rotated to go radial position and pushed in. When it is pushed into the tube container, the applicator functions as a push rod to open the top cap. The used applicator may be reinserted in an altered orientation, e.g., shortened or turned upside down and inserted, with the bottom cap pushed in, and the top cap reinserted into the top, access to the used applicator is inhibited.

U.S. Pat. No. 6,880,729 B2 to Gene Stull et al describes a secure lock for container packaging with a flexible retaining lip of various formations for sealing against material product flow distributions with the secure seal preventing tampering of, for example, a flexible walled container of material such as a medication, food stuff or art material. A resistant secure lock is provided which in one embodiment meets Federal Child Safety Standards providing a seal of flexible locking and unlocking which is resistant to a child's tampering. In one embodiment, a tamper resistant seal is formed for a squeezable container cap with a flexible hinging structure connecting a cap to a cap receptor base structure of a container to prevent a material product such as medicine from dispensing without disengaging the seal selectively to allow access to an aperture, yet with a directed flexion of a lip or head, the seal simply unsnaps from a tamper resistant state to release the flow of product through an aperture from a container.

U.S. Pat. No. 6,032,811 to Anthony Marconi describes a child resistant cap assembly that includes an outer cap member having a top wall and a substantially cylindrical side wall depending therefrom. On the exterior surface of the top wall is a key slot and an alignment aperture. An inner cap member for threadedly engaging a container neck is concentrically received within said outer cap member has a mark and key slot on its top wall. The outer cap member normally rotates independently of the inner cap member. When the outer cap member's alignment aperture registers with the mark on the inner cap member, the key slots are aligned allowing a key member to be inserted therethrough. Accordingly, the inserted key member is then rotated to simultaneously rotate the inner and outer cap. The top wall of the outer cap member also includes means for removably retaining the key thereon.

U.S. Pat. No. 6,029,835 to Stuart DeJonge describes a child resistant safety cap for containers that includes an outer cap, an inner cap, at least one retractable-extendable key arm and a biasing spring. The outer cap has a top and a sidewall with a plurality of openings for retraction and extension of the key arms therethrough, and the top has an engaging mechanism for engaging and disengaging the key arms. The inner cap is contained within the outer cap, has a sidewall and a top, with a slide mechanism for slideably attaching a plurality key of arms. The inner cap is a predetermined height less than the inside vertically slidable within the outer cap. The inner cap has a first vertical position away from the top of the outer cap wherein said engaging mechanism of the outer cap and the connecting mechanism of the plurality of key arms are disengaged, and the inner cap has a second vertical position, toward the top of the outer cap wherein the engaging mechanism and the connecting mechanism are engaged. The inner cap also has threading on its inside for screwing onto and off a threaded container.

U.S. Pat. No. 5,749,484 to Stanley D. Trout describes a child-resistant, tamper-evident closure for a container having an externally threaded neck finish includes a combination of inner and outer caps. The inner cap includes a tamper-evident band which is connected to the inner cap by frangible elements. The inner cap includes folded ratchet-like tabs which are locked in position behind an annular bead. The tabs are arranged so as to engage an annular lip on the neck finish. The outer cap snaps over the inner cap and includes a series of ratchet-like lugs which are directed toward the inner cap. The top surface of the inner cap includes a series of cooperating ratchet-like lugs. So long as a downward force is not excreted on the outer cap, the child-resistant arrangement permits the outer cap to turn relative to the inner cap in a counterclockwise direction. However, when a sufficient downward force is applied, the lugs of the outer cap are drawn into abutment with the cooperating lugs of the inner cap and the outer cap is used to remove the inner cap. In the clockwise direction, the lugs cooperate such that turning of the outer cap advances the inner cap into threaded engagement. In another embodiment, removal of the inner cap from the neck fish is achieved by ovalizing the outer cap so as to bring into engagement ribs on the inner cap with ribs on the inside surface of the sidewall of the outer cap.

U.S. Pat. No. 5,732,836 to Allan Barker et al. describes a closure for a container, including means for counting and indicating the number of times the closure has undergone a cycle of closing and opening the container, and further including means for incorporating the closure into means for resisting the opening of the container by a child. In a preferred embodiment, the closure includes an outer cover having an indicator symbol window an indicator symbol carrier rotatably mounted in the outer cover with indicator symbols visible through the indicator window, tooth and pawl means for allowing one-way rotation of the outer cover relative to the indicator symbol carrier to allow the advancement of the window and an audible click as the pawl passes over a tooth to confirm proper advancement, lost motion means for positively assuring the advancement of the window by one and only one indicator symbol upon each cycle, and a closure mechanism requiring the application of an axial force urging the closure toward the container while applying a rotational force to disengage the closure from the container.

U.S. Pat. No. 5,509,550 to Stuart DeJonge describes the child resistant cap device for containers with a threaded neck openings. It includes an inner cap, an outer cap and a key bar. The inner cap has a top and a sidewall having threads on its inside. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key which is pivotable for 180° rotation so as to be engageable with the key arrangement of the inner cap so as to permit opening of the inner cap by rotation of the outer cap when the release key is engaged in the release key engagement.

U.S. Pat. No. 5,381,912 to Linda A. Walker describes an improved child-resistant package allowing improved access and closure by the user is provided. The improved package is of the press-and-turn type and features ramped gripping portions on the perimeter of the side of the press-and-turn cap and on the bottle.

U.S. Pat. No. 4,854,459 to Antonia DeJonge describes the present invention involves a container and cap which is generally childproof and may be rendered non-childproof permanently. The invention involves a container having a cylindrical neck at the top and threads molded about the exterior of the neck as well as an inner cap and outer cap. The inner cap has a top and a cylindrical side wall with threads molded on the inside of the side wall so as to mate with the threads of the container. The top or side of the inner cap has ratchet type segments on its outside and the outer cap has ratchet type segments on the inside of its top or side. The outer cap has a cylindrical side wall and is usually freely rotatable about the inner cap so as to be childproof. When in the childproof configuration as described, downward pressure is required by the user so as to engage the two ratchet type segments and thereby engage the two caps to permit opening. Further, the outer cap has an opening in its side wall at a lever near the bottom of the side wall of the inner cap and also has integrally attached thereto a flexible connector and stop. The flexible connector and stop are located so as to permit insertion of the stop into the opening so as to extend beyond the opening and push up the inner cap so as to permanently lock it into a position wherein the inner cap and outer cap ratchet type segments are permanently engaged. This renders the cap permanently non-childproof.

U.S. Pat. No. 4,555,035 to Eugene Davis describes a closure for a container. The closure is provided with a tunnel member into which any appropriate implement such as the handle of a teaspoon can be inserted when it is desired to manipulate the closure e.g. for opening. The provision of the tunnel member is of great assistance to people lacking in manual dexterity.

U.S. Pat. No. 4,333,589 to Randall Bush describes a child-resistant overcap for a pressurized container, such as an aerosol can, having a valve with an axially protruding discharge nozzle which must be depressed to actuate the valve for discharging the contents of the container. The overcap includes a valve guard moveable between an outer position in which a portion of the guard overlies the nozzle for preventing actuation thereof and an inner position in which the nozzle can be depressed. The overcap includes a resilient portion of the guard which biases the guard toward outer position and which must be overcome in order to move the guard to inner position and which returns the guard to outer position when the guard is released.

U.S. Pat. No. 4,325,497 to Ronald Ewald describes a child resistant spray through cover assembly for aerosol and similar containers. The cover assembly is adapted to be applied to a container having a conventional actuator button with a discharge outlet in which the actuator button discharges when it is moved axially toward the container. The cover assembly includes a housing which is adapted to fit over the actuator button and to be securely attached to the container. An opening is formed in the housing to allow the passage of spray discharge through the discharge outlet of the actuator button. A moveable flap is mounted on the housing and extends over the actuator button. The flap is moveable upon the application of force thereto by a finger of a user between a first position in which it is located out of actuating engagement with the actuator button and a second position in which it is in actuating engagement with the actuator button. A locking mechanism is provided to retain the flap in its first position. A finger engaging mechanism is provided for releasing the locking mechanism to permit the flap to be moved to its second position. A mechanism is provided on the flap for depressing the actuator button when the flap is moved to its second position. A spring arrangement is provided to return the flap to its first position and the locking mechanism to locking engagement with the flap when the application of force to the flap is discontinued so that the child resistant features of the cover assembly are automatically restored after the use and without any active participation of the user.

U.S. Pat. No. 3,831,804 to John Richard Focht describes an aerosol safety cap for an aerosol container including inner and outer telescoping members. The outer member includes dependant resilient locking means which snap under the interior of the annular bead of the mounting cup of the aerosol container to affix the outer member to the container. When the inner member is telescoped into the outer member, it prevents the resilient locking means from being inwardly deflected thereby preventing removal of the cap assembly from the container. Withdrawal of the inner telescopic member permits deflection of the depending locking means to permit removal of the cap from the container. The inner membrane cannot be withdrawn without the aid of a prying instrument such as a coin. The cap can be doubly locked by rotating the inner member with respect to the outer member with an instrument such as a coin into a position in which it can be pried upwardly.

Notwithstanding the prior art, the present invention is neither taught nor rendered obvious thereby.

SUMMARY OF INVENTION

The present invention relates to a child resistant container with inverting cap bottom lift. It includes: (a) a container main body having an open top, a sidewall, and a bottom, said container bottom having at least one lift rod slot, said container main body adapted to receive a vertical nozzle push with a top-positioned vertical nozzle push actuator; (b) an actuator flange located on said open top of said container main body and projecting inwardly therefrom, said flange being of sufficient length to create an orifice large enough to permit a vertical nozzle of a vertical nozzle push container to pass therethrough and small enough to prevent said vertical nozzle push container push actuator from passing therethrough; (c) a cap adapted to fit over and onto said container main body, said cap having a closed top, a sidewall and at least one downwardly projecting extended lift rod having a length equal to at least the distance between the top of a vertical nozzle and an activated push actuator of said vertical nozzle push container; wherein a user may insert a vertical nozzle push container into said container main body, permanently attach said bottom to said container main body, and cover said with said cap and said container main body for storage and safekeeping; and, wherein a user may subsequently remove said cap, invert it, place it on the bottom of said container main body and align the at least one lift rod with said container main body bottom at least one lift rod slot, and push up said cap to cause said at least one lift rod to push said vertical nozzle push container up and to thereby push said push actuator up to expose it to said flange and to thereby further push up said cap and at least one lift rod to push said push actuator against said flange and activate it for release of contents of said vertical nozzle push container.

In some embodiments of the present invention child resistant container with inverting cap bottom lift, the container main body and the cap have circular top view footprints.

In some embodiments of the present invention child resistant container with inverting cap bottom lift, the cap extends downwardly over the container main body and is friction fitting to the container main body.

In some embodiments of the present invention child resistant container with inverting cap bottom lift, the top orifice includes open area adapted to receive said at least one downwardly projecting lift rod of said cap, and said at least one downwardly projecting lift rod extends through said open area when said outer cap is attached to said container main body.

In some embodiments of the present invention child resistant container with inverting cap bottom lift, there are at least two downwardly projecting lift rods on said cap and there are an equal number of corresponding key slots on said bottom of said container main body.

In some embodiments of the present invention child resistant container with inverting cap bottom lift, there are at least two downwardly projecting extended lift rods and they have symmetrically identical bottom view footprints.

In some embodiments of the present invention child resistant container with inverting cap bottom lift, there are at least two downwardly projecting extended lift rods with different bottom view footprints and there are at least two corresponding different lift rod slots, such that said bottom has only correct position for push rod insertion and subsequent use.

In some embodiments of the present invention child resistant container with inverting cap bottom lift, the main body includes a finger grip protrusion.

In some embodiments of the present invention child resistant container with inverting cap bottom lift, the bottom is a separate component, said container has a first locking member and said bottom has a second locking member, wherein said locking members are coinciding components with a force-fit locking protrusion and recess. In some of these embodiments of the present invention child resistant container with inverting cap bottom lift, said container main body, said separate bottom and said cap have circular top view footprints. In some of these embodiments of the present invention child resistant container with inverting cap bottom cap extends downwardly over said container main body and is friction fitting to said container main body. In some of these embodiments of the present invention child resistant container with inverting cap bottom lift, wherein bottom is a separate component, said container has a first locking member and said bottom has a second locking member, wherein said locking members are coinciding components with a force-fit locking protrusion and recess.

In some embodiments of the present invention child resistant container with inverting cap bottom lift, the top is a separate component, said container has a first locking member and said top has a second locking member to permanently connect said top to said main body. In some of these embodiments of the present invention child resistant container with inverting cap bottom lift, said container main body, said separate top and said cap have circular top view footprints. In some of these embodiments of the present invention child resistant container with inverting cap bottom cap extends downwardly over said container main body and is friction fitting to said container main body. In some of these embodiments of the present invention child resistant container with inverting cap bottom lift, wherein top is a separate component, said container has a first locking member and said bottom has a second locking member, wherein said locking members are coinciding components with a force-fit locking protrusion and recess.

In some embodiments of the present invention child resistant container with inverting cap bottom lift, the main body has separate sections, being an upper section and a lower section, and said upper section has a first locking member and said lower section has a second locking member to permanently connect said upper section to said lower section. In some of these embodiments of the present invention child resistant container with inverting cap bottom lift, said container main body and said cap have circular top view footprints. In some of these embodiments of the present invention child resistant container with inverting cap bottom cap extends downwardly over said container main body and is friction fitting to said container main body. In some of these embodiments of the present invention child resistant container with inverting cap bottom lift, wherein there are separate main body components, said components have a first locking member and a second locking member, wherein said locking members are coinciding components with a force-fit locking protrusion and recess.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
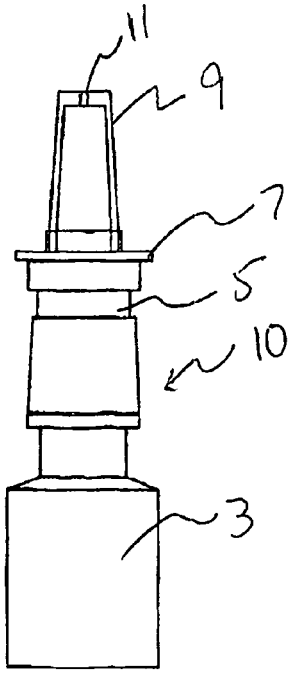
FIG. 1 illustrates a front view of a typical vertical nozzle spray container with a push mechanism for which the present invention child resistant container with inverting cap bottom lift has been developed.

The invention relates generally to a child resistant container that is adapted to receive and to lock in a vertical dispensing container, e.g., a sprayer container, with a top-positioned vertically reciprocating dispensing actuator. The device is particularly beneficial as a retrofit child resistant container for potentially dangerous spray products to children, e.g., medicines, oven cleaners, etc. The device has a container main body for receiving the sprayer container, a top cap to lock in the spray container and to allow the spray actuator of the spray container to rise up and down. In the up position, the spray actuator may be used to activate a spray, and in the down position, the spray actuator cannot be activated successfully. The top cap thus has a top orifice that lets the spray actuator be moved up and down through it, yet its opening is small enough to inhibit removal of the spray container itself. A cap acts as an overcap and can be removed and inverted to expose lift rod(s). The lift rod(s) are fitted upwardly on the underside of the container main body bottom in the lift rod slots that geometrically correspond to and receive the lift rod(s). When the cap is thus inverted and bottom inserted, it is merely pushed upwardly to expose the spray actuator for use.

Referring now to the drawings wherein like reference numerals designate corresponding parts throughout the several views, the present invention is exemplified as follows:

FIG. 1 illustrates a front view of a typical vertical nozzle spray container 10 with a push mechanism for which the present invention child resistant container with inverting cap bottom lift may be used. It includes a container housing 3 for the liquid, foam or gel content that is to be dispersed, typically materials that may be harsh or harmful to children, e.g. adult dosage medicine. The vertical nozzle spray dispenser 10 also has a cap 5 with a vertical motion, reciprocating, upwardly biased, spray actuator 7, and a vertical nozzle 9 with vertical release orifice 11. Although these containers are herein sometimes referred to as "spray" containers; the word "spray" is intended to be exemplary and not restricting. Any container with a push down vertical actuator may be included in the present invention devices without exceeding its scope, e.g. a vertical actuator liquid or gel release that creates a stream rather than a spray, is included.

Figure 2:
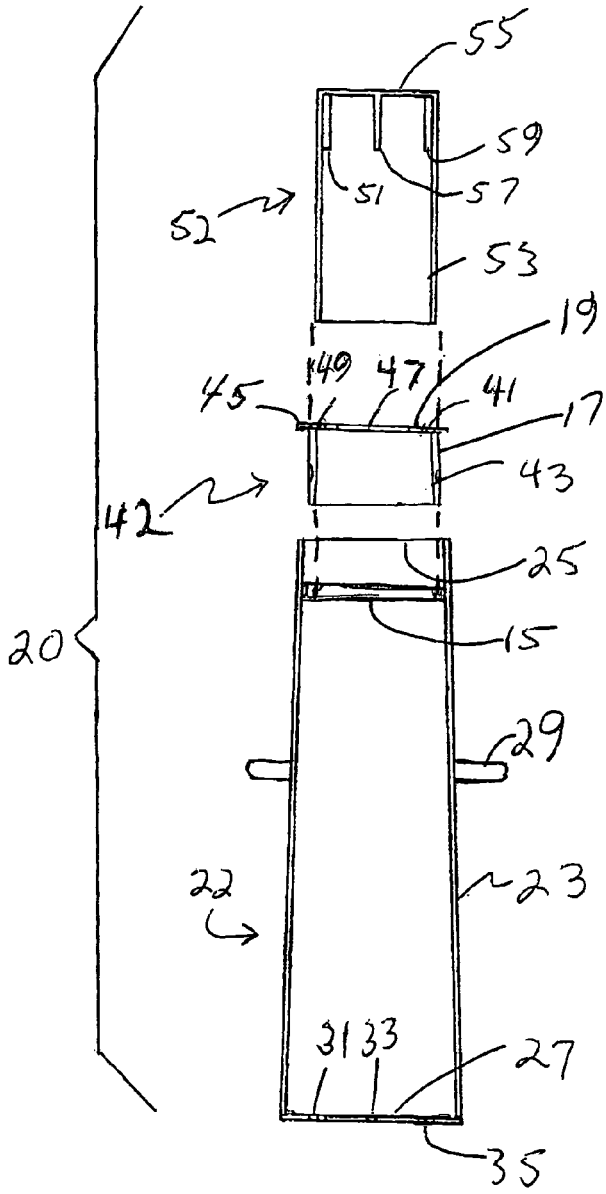
FIG. 2 shows the front, exploded, cut view of a present invention child resistant container with inverting cap bottom lift with a separate main body top.

FIG. 2 shows the front, exploded, cut view of a present invention child resistant container 20 with inverting cap bottom lift with a separate main body top. There is a main housing that consists of a main body component 22 and a separate, force fit top 42. The main body component 22 has finger grip 29, sidewall 23, bottom 27, and open top area 25 and grip protrusion(s) 29. Bottom 27 has one or more, in this drawing, three lift rod slots 31, 33, and 35 for receiving corresponding lift rods on the cap. Inside sidewall 23 is a first locking mechanism 15 (a protrusion) for locking top 42. Lock 42 has a sidewall 17 with second locking mechanism, namely, recesses 17, to snap onto first locking mechanism 15. The top 42 also has a top area with an orifice 47 (for nozzle 9 of container 10 of FIG. 1 to protrude from) and a spray container actuator flange 19, as well as optional rod-receiving orifices such as orifice 41 and 49.

Cap 52 of FIG. 2 has a sidewall 53 and lift rods 51, 57, and 59. In this embodiment, the lift rods are guides and the sidewall acts as the direct lift rod (in some other embodiments, such as further described below, the lift rods are direct purchases and/or guides and/or keys.)

Figure 3:
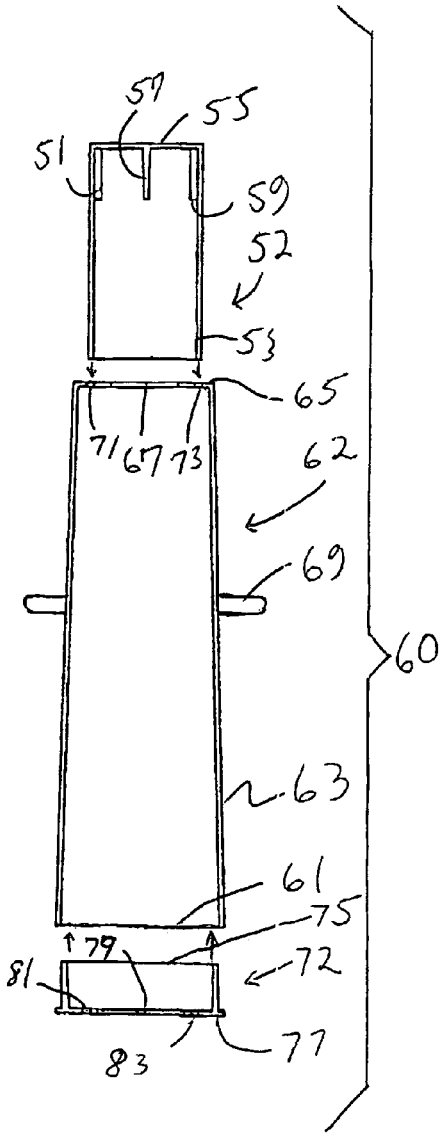
FIG. 3 illustrates a front, exploded, cut view of a present invention child resistant container with inverting cap bottom lift with a separate main body bottom.

FIG. 3 illustrates a front, exploded, cut view of a present invention child resistant container 60 with inverting cap bottom lift with a separate main body bottom. The cap 52 is the same as described above for FIG. 2 and is likewise the same in FIGS. 4,5,6,7, and 8 and identical parts are identically numbered and not otherwise repeatedly described below. Here the main body component 62 has an integral top 65, grippers 69, and an open area bottom for receiving a spray container therethrough and permanently attaching separate bottom 72 thereto after the spray container has been inserted therein. As in FIG. 2, the bottom 72 has lift rod rod-receiving slots 79, 81, and 83. Bottom 72 also has an open top area 79 and a stop 77 for efficient filterage to main body component 62. The functionality of this FIG. 3 embodiment is described in conjunction with FIG. 5 through 8 below and is equally applicable to the other embodiments set forth in FIGS. 2 and 4.

Figure 4:
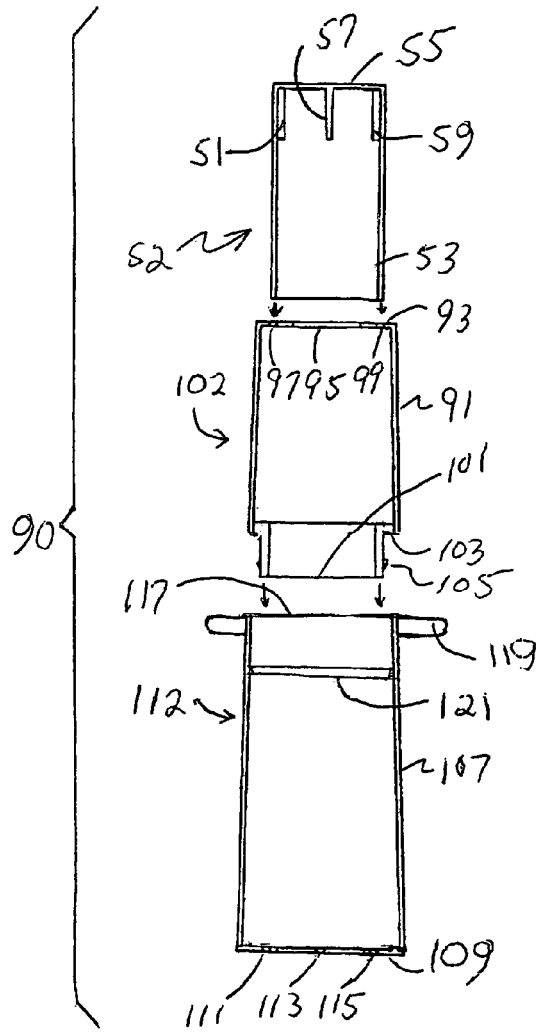
FIG. 4 illustrates a front, exploded, cut view of a present invention child resistant container with inverting cap bottom lift with two separate main body sections.

FIG. 4 illustrates a front, exploded, cut view of a present invention child resistant container 90 with inverting cap bottom lift with two separate main body sections 102 and 109. In this embodiment, top 93 is an integral part of body upper section 102 and bottom 109 is an integral part of main body lower section 112. Upper section 102 has a sidewall 91, or nozzle orifice 97, push rod orifice 97 and 99 and open bottom area 101, with stop ledge 103 and first locking mechanism 105. Lower section 112 includes lift rod slots 111, 113 and 115 at its bottom 109, finger grips 119 and second locking mechanism 121 for interaction with first locking mechanism 105. A vertical actuator dispenser container is placed n one of the upper section 102 and lower section 112 and the two sections are filtered together in ten locking mechanisms.

Figure 5:
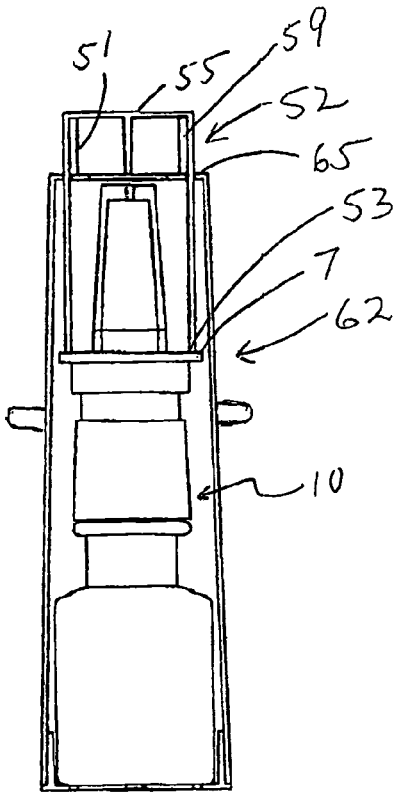
FIG. 5 shows a fully assembled present invention child resistant container with inverting cap bottom lift in a child resistant mode with a vertical nozzle push container enclosed therein, for subsequent use by a knowledgeable user.

FIG. 5 shows a fully assembled present invention child resistant container 62 with inverting cap bottom lift in a child resistant mode with a vertical nozzle push container enclosed therein, for subsequent use by a knowledgeable user. This illustrates the present invention FIG. 3 device in its rest state as it would be when first obtained by a user.

Figure 6:
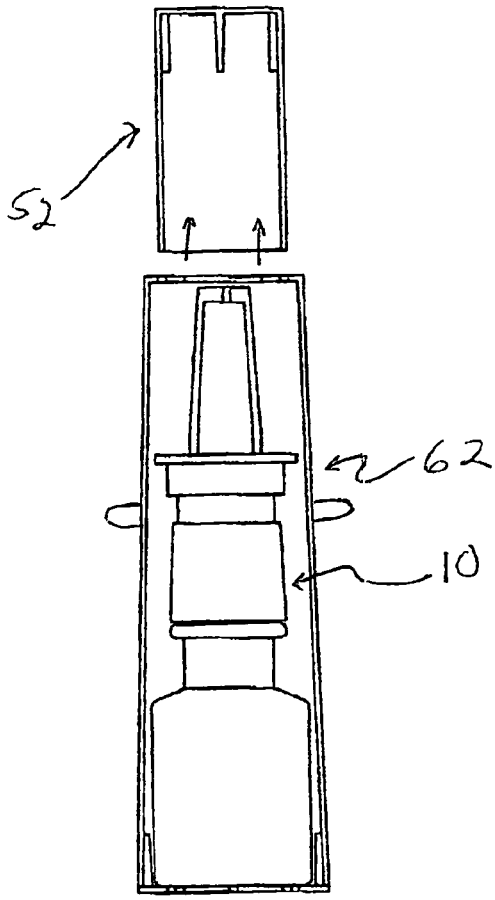
FIG. 6 illustrates a front cut view of the present invention device shown in FIG. 5, but with the cap removed.
Figure 7:
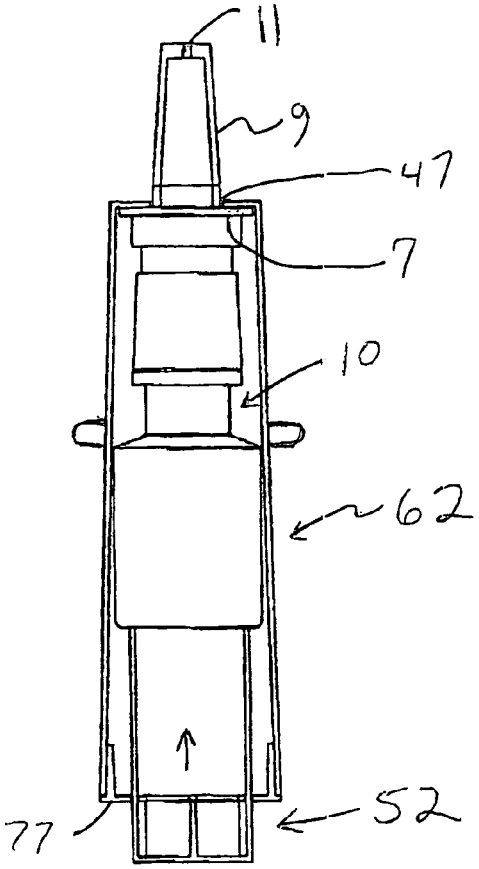
FIG. 7 shows the present invention device shown in FIG. 6, but with the cap inverted and inserted into the bottom.
Figure 8:
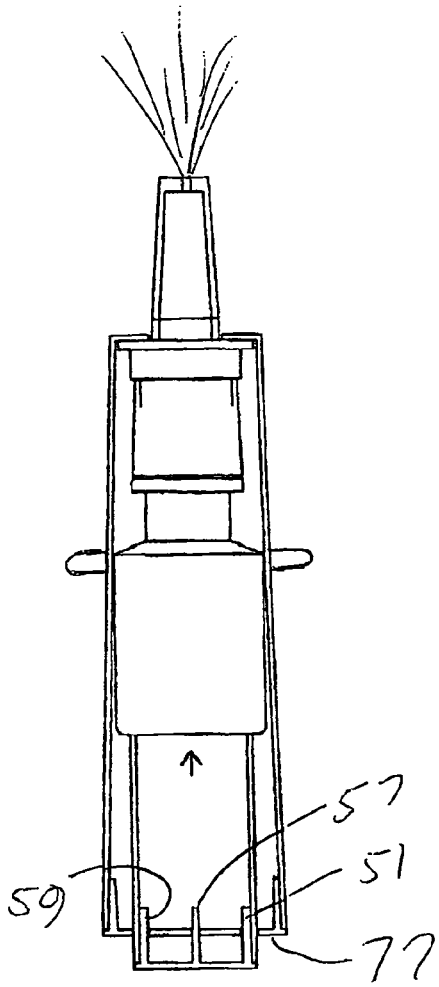
FIG. 8 shows the present invention device shown in FIG. 7 with the inverted cap fully pushed up to cause the top of the present invention device to create relative movement between the vertical nozzle push container and its actuator to release content.

FIG. 6 illustrates a front cut view of the present invention device shown in FIG. 5, but with the cap removed. FIG. 7 shows the present invention device shown in FIG. 6, but with the cap inverted and inserted into the bottom. FIG. 8 shows the present invention device shown in FIG. 7 with the inverted cap fully pushed up to cause the top of the present invention device to create relative movement between the vertical nozzle push container and its actuator to release content. The material released may be any flavorable material and the duration of release is equal to the full depression time of the user (when the user releases pressure from the inverted cap 52 at the bottom 72), or until the supply of material and/or propellant is exhausted. Typically, a user will be directed by the manufacturer as to depression (actuator) time to control dosage, e.g. three second burst.

Figure 9:
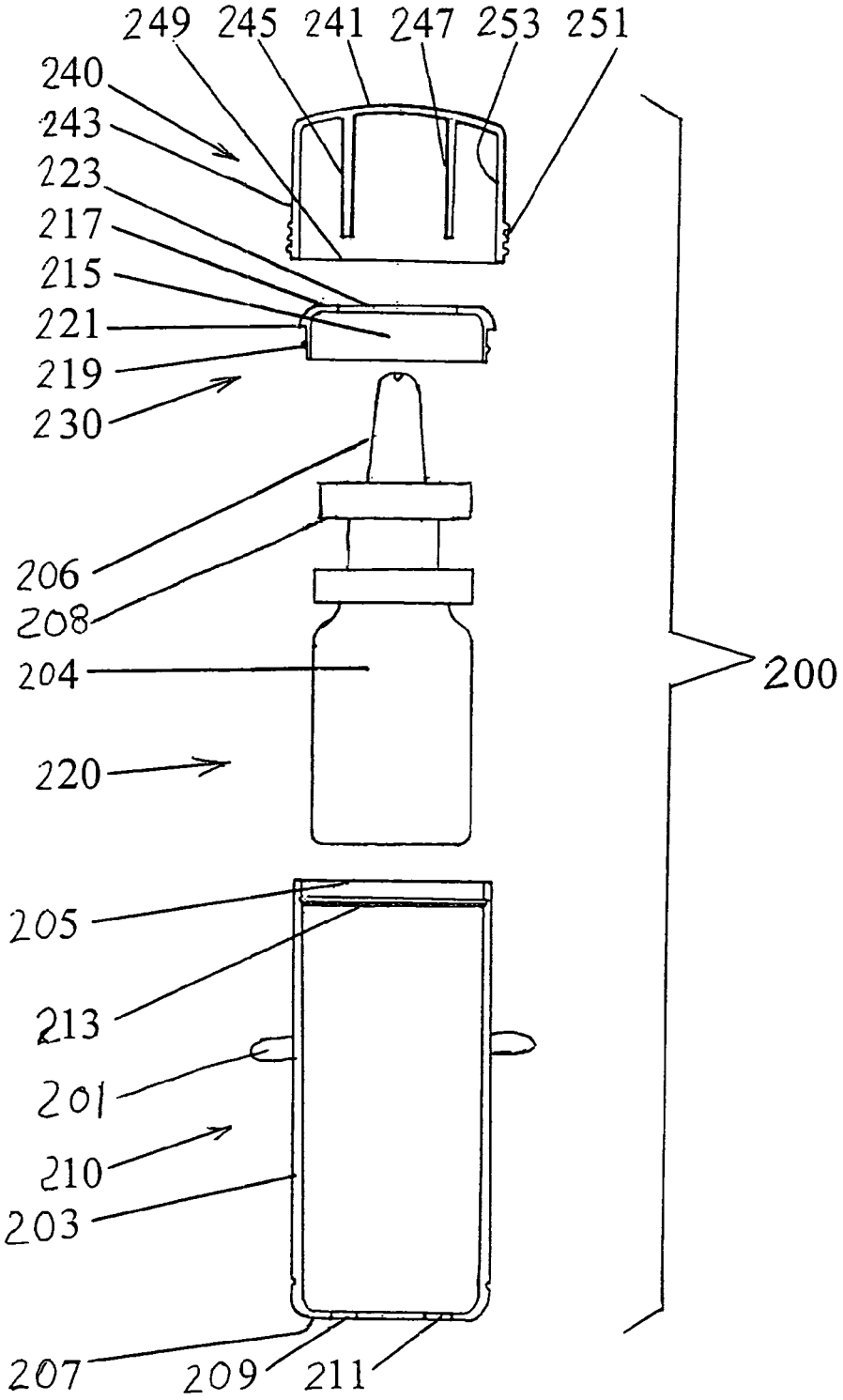
FIG. 9 shows an exploded cut front view of a another present invention child resistant container with inverting cap bottom lift features and also shows an uncut front view of a sprayer container with a top-mounted spray actuator and nozzle.

FIG. 9 shows an exploded cut front view of another present invention child resistant container 200 with inverting cap bottom lift features and also shows an uncut front view of a sprayer container with a top-mounted spray actuator and nozzle. These are collectively shown as loaded present invention device 200. The present invention child resistant container includes a container main body component 210, a separate top component 230 and a cap 240. The container main body component 210 has an open top area 205 (for receiving the top component 230), a circular sidewall 203 and a bottom 207. Although sidewall 203 has a circular top view footprint, it could take any shape that would receive a spray container. Further, it need not have the same footprint shape as a spray container. For example, a circular spray container would readily fit into a hexagonal or octagonal container main body.

Figure 10:
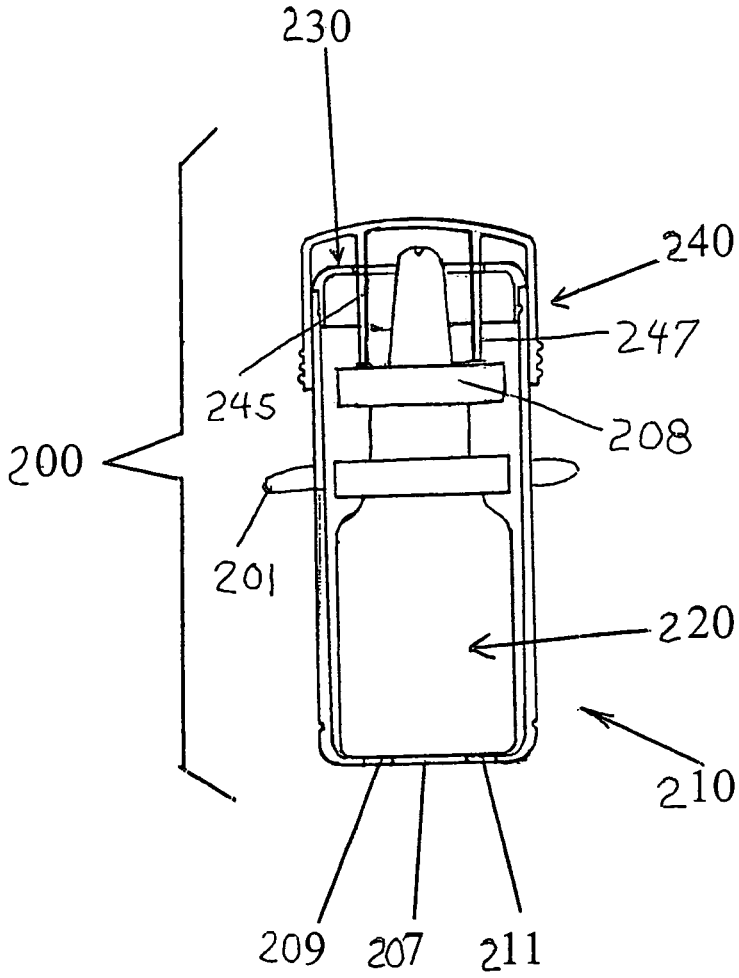
FIG. 10 illustrates a cut front view of the present invention child resistant container of FIG. 9, but in its child resistant assembled and closed mode.

Container main body component 210, in this example, has two symmetrical lift rod slots 209 and 211 in its bottom 207. These are to receive lift rods from cap 240, as more fully described below. Although this FIG. 9 shows an exploded view, FIG. 10 illustrates a fully assembled view of the same elements. Thus, in FIG. 10, the loaded device is also collectively shown as present invention device 200. The following and foregoing discussion is in reference to both FIG. 9 and FIG. 10.

Spray container 220 has sidewall 204 and a top-positioned vertical spray actuator 208 and a vertical spray nozzle 206. Preferably, container main body component 210 is designed to receive spray container 220 with slight friction to prevent rattling. On the inside of sidewall 203 of container main body component 210, near the open area top 205, is a first locking member 213 for receiving and locking top 230 thereto. Thus, spray container 220 is inserted into container main body component 210 and then top 230 is permanently attached to open area 205.

Top 230 has a sidewall 215 and a top portion 217 with spray actuator orifice 223. Top 230 also has a flange 217 to catch vertical spray actuator 208, and has a second locking member 219. When top 230 is pushed into container main body component 210, the male locking track, also known as second locking member 219, snaps into female receiving first locking member 213 of container main body component 210 with flange 217 fitting atop sidewall 203. Orifice 223 is large enough in its opening to permit spray nozzle 206 of spray container 220 to pass therethrough, but small enough to prohibit actuator 208 of spray container 220 from passing therethrough. As can be seen in both Figures, the spray nozzle is narrower than the main body's top orifice 223, enabling spray actuator to function as described above, i.e., allowing the spray nozzle to pass therethrough but otherwise restraining the spray container actuator. The device is very child resistant as shown in FIG. 10, yet is easily activated by an adult following the steps described below.

Cap 240 has a top 241 and a sidewall 243, as shown. Cap 240 has an open bottom 249. The inside 253 of sidewall 243 of cap 240 is, in this embodiment, adapted to fit over top 230 and to snuggly fit onto container main body component 210. Extending downwardly from the inside of top 241 of cap 240 are two push rods 245 and 247. These have the same footprint and are positioned to fit into push rod slots 209 and 211 when outer cap 40 is inverted and positioned as discussed below. Also, push rods 245 and 247 are of sufficient length such that when they are inserted into push rod slots 209 and 211, they will lift up spray container 220 to expose spray nozzle 206 and depress actuator 208 for use. As mentioned above, FIG. 9 is an exploded partially cut view and FIG. 10 shows the same partially cut elements fully assembled.

Figure 11:
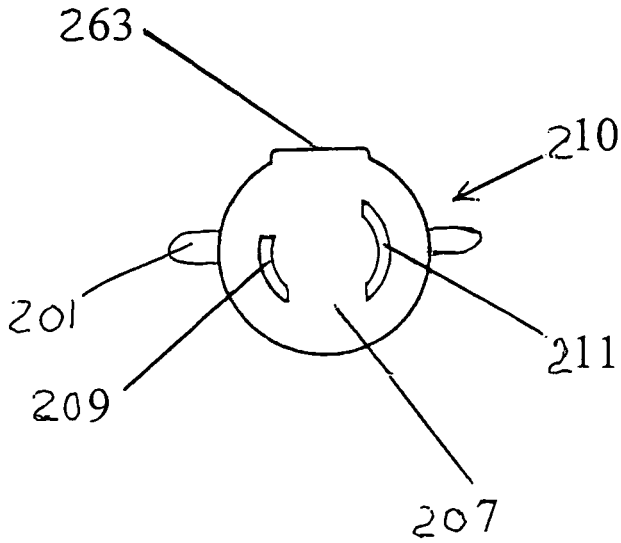
FIG. 11 illustrates a bottom view of the present invention child resistant container of FIG. 10.
Figure 12:
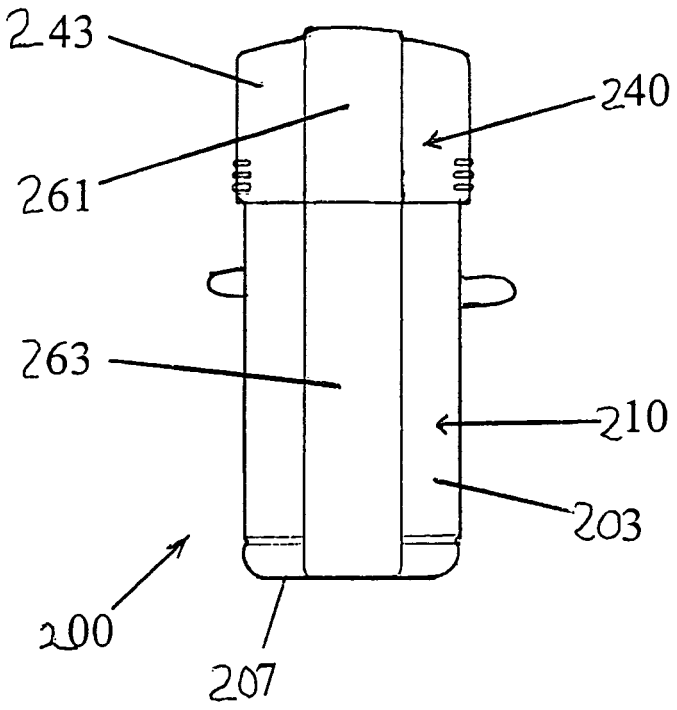
FIG. 12 shows an uncut front view and FIG. 13 shows a top view of the preferred present invention child resistant container illustrated in the preceding figures.
Figure 13:
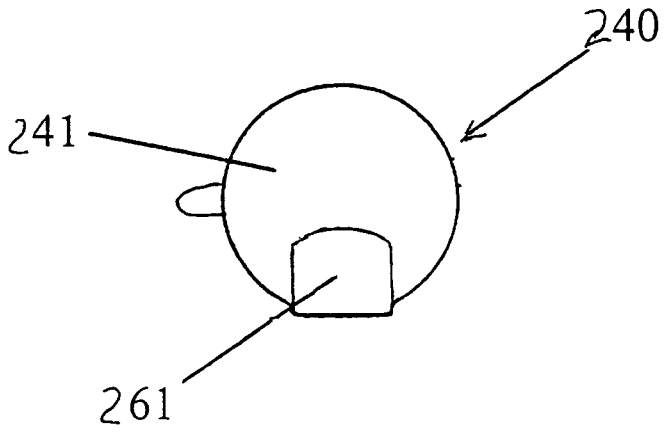

FIG. 11 shows a bottom view, FIG. 10 shows a front view and FIG. 13 shows a top view of the preferred present invention device illustrated in the preceding figures. Identical parts in these figures are identically numbered as presented in the previous drawings. These are also true of the subsequent FIGS. 14 through 17 below and, hence, are not necessarily repeated further herein. FIGS. 12 and 13 show a vertical guide track that extends vertically as first track 263 on container main body component 210 and as second track 261 on cap 240. It is not shown, but on container main body component 210 track 263 extends vertically upwardly to the top edge of container main body component 210 so that it partially nests under track 261.

Figure 14:
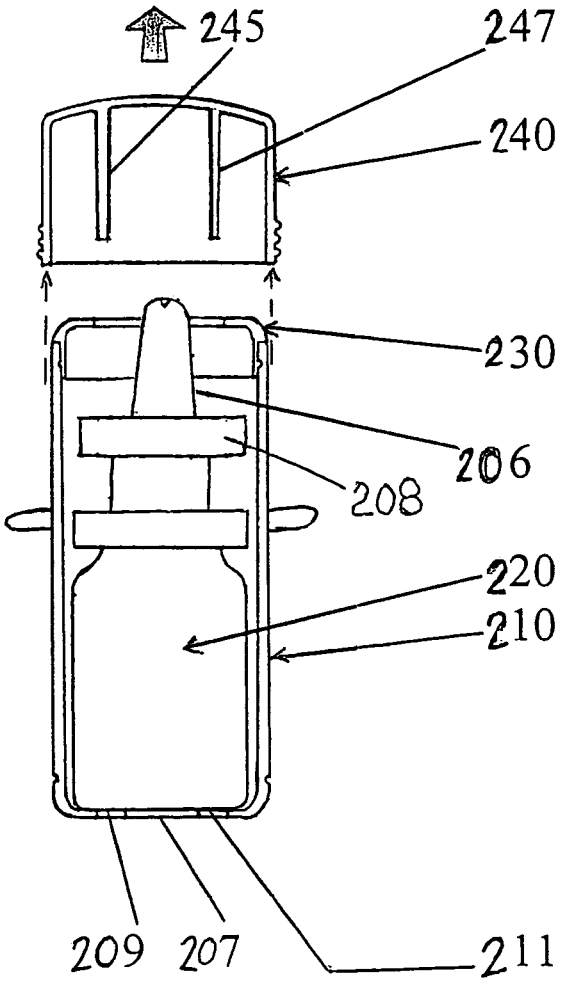
FIG. 14 shows a present invention child resistant container of FIGS. 9 through 13 with the caps removed from the container's main body.

FIG. 14 shows a present invention device 200 of FIG. 10 with the present invention container cap 240 lifted off the main body component 210 and one removing the outer cap 240 therefrom.

Figure 15:
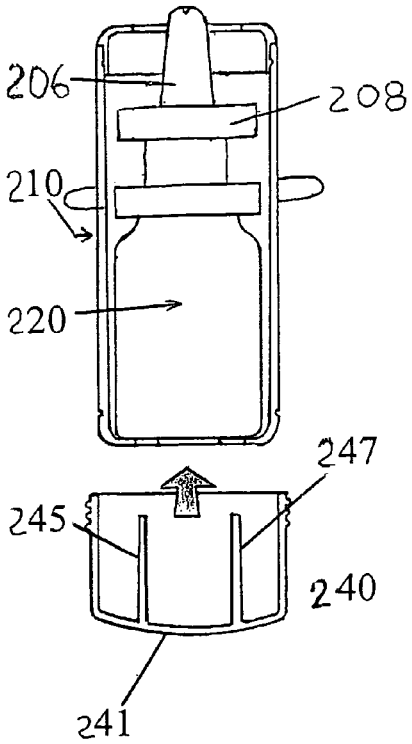
FIG. 15 shows the present invention device of FIGS. 9 through 14 but with the removed cap now inverted and moving toward the underside of the container main body for subsequent push up of the spray container.

FIG. 15 shows the present invention device of FIGS. 10 and 14 but with the removed cap 240 now inverted and moving toward the underside (bottom 207) of the container main body component 210 for subsequent push up of the spray container 220.

Figure 16:
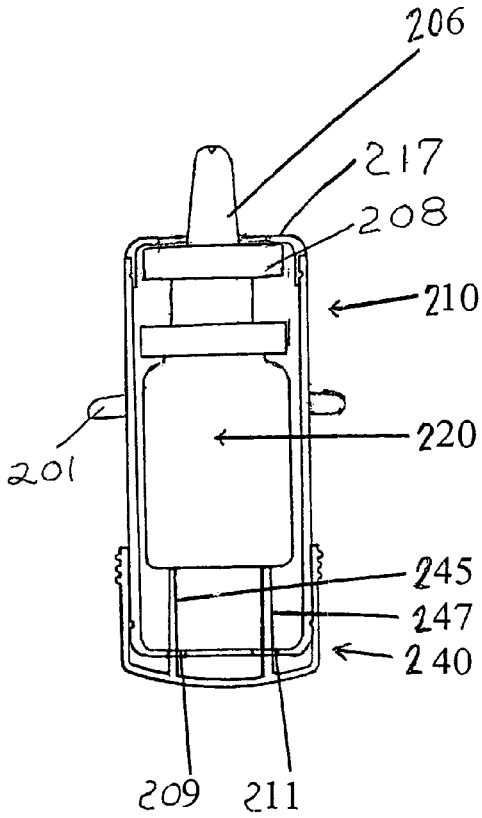
FIG. 16 shows a cut view of the present invention device illustrated above, but pushed up until the push actuator is touching the flange to expose the spray actuator for use.

FIG. 16 shows a cut view of the present invention device illustrated above, but partially pushed up with the push rods 245 and 247 significantly into push rod slots 207 and 209, as shown, so as to lift the spray container 220 to expose the vertical nozzle 206 and touch the spray actuator 208 to the underside of flange 217.

Figure 17:
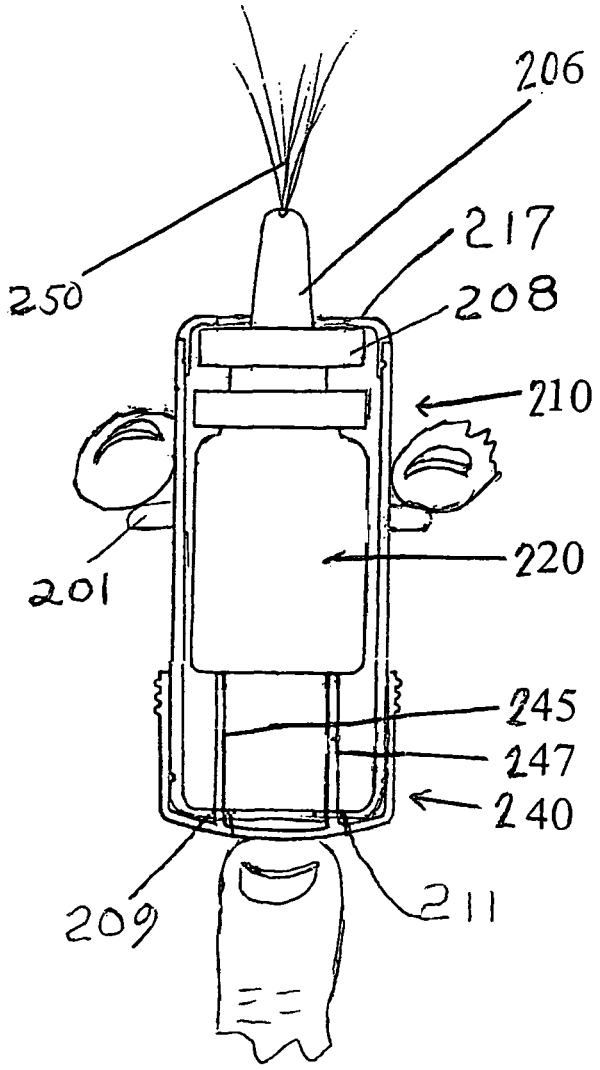
FIG. 17 shows a person's hand using the present invention device as shown in FIG. 16, but with the spray actuator being depressed and spraying through the vertical nozzle.

FIG. 17 shows a person's hand (two fingers and a thumb shown) using the present invention device wherein full upward thumb force depresses actuator 208 to release container 220 content (as spray 250). After use, the cap 240 is removed from the bottom 207 and replaced on top 230 as shown in FIGS. 10 and 12.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A child resistant container with inverting cap bottom lift for receiving, protecting and activating a vertical nozzle, push container, which comprises:

(a) a container main body having a top with a top orifice, a sidewall, and a bottom, said container bottom having at least one lift rod slot, said container main body adapted to receive a vertical nozzle push with a top-positioned vertical nozzle push actuator;

(b) an actuator flange located on said open top of said container main body and projecting inwardly therefrom, said flange being of sufficient length to establish said top orifice large enough to permit a vertical nozzle of a vertical nozzle push container to pass therethrough and small enough to prevent said vertical nozzle push container push actuator from passing therethrough;

(c) a cap adapted to fit over and onto said container main body, said cap having a closed top, a sidewall and at least one downwardly projecting extended lift rod having a length equal to at least the distance between the top of a vertical nozzle and an activated push actuator of said vertical nozzle push container;

wherein a user may insert a vertical nozzle push container into said container main body, permanently attach said bottom to said container main body, and cover said with said cap and said container main body for storage and safekeeping; and, wherein a user may subsequently remove said cap, invert it, place it on the bottom of said container main body and align the at least one lift rod with said container main body bottom at least one lift rod slot, and push up said cap to cause said at least one lift rod to push said vertical nozzle push container up and to thereby push said push actuator up to expose it to said flange and to thereby further push up said cap and at least one lift rod to push said push actuator against said flange and activate it for release of contents of said vertical nozzle push container.

2. The child resistant container with inverting cap bottom lift of claim 1 wherein said container main body and said cap have circular top view footprints.

3. The child resistant container with inverting cap bottom lift of claim 1 wherein said cap extends downwardly over said container main body and is friction fitting to said container main body.

4. The child resistant container with inverting cap bottom lift of claim 1 wherein said top includes open area adapted to receive said at least one downwardly projecting lift rod of said cap, and said at least downwardly projecting lift rod extends through said top open area when said cap is attached to said container main body.

5. The child resistant container with inverting cap bottom lift in claim 1 wherein there are at least two downwardly projecting lift rods on said cap and there are an equal number of corresponding key slots on said bottom of said container main body.

6. The child resistant container with inverting cap bottom lift of claim 1 wherein said bottom is a separate component, said container has a first locking member and said bottom has a second locking member, wherein said locking members are coinciding components with a force-fit locking protrusion and recess.

7. The child resistant container with inverting cap bottom lift of claim 6 wherein said container main body, said separate bottom and said cap have circular top view footprints.

8. The child resistant container with inverting cap bottom lift of claim 6 wherein said cap extends downwardly over said container main body and is friction fitting to said container main body.

9. The child resistant container with inverting cap bottom lift of claim 1 wherein said main body includes a finger grip protrusion.

10. The child resistant container with inverting cap bottom lift of claim 1 wherein said there are at least two downwardly projecting extended lift rods and they have symmetrically identical bottom view footprints.

11. The child resistant container with inverting cap bottom lift of claim 1 wherein said there are at least two downwardly projecting extended lift rods with different bottom view footprints and there are at least two corresponding different lift rod slots, such that said bottom has only correct position for push rod insertion and subsequent use.

12. The child resistant container with inverting cap bottom lift of claim 1 wherein bottom is a separate component, said container has a first locking member and said bottom has a second locking member, wherein said locking members are coinciding components with a force-fit locking protrusion and recess.

13. The child resistant container with inverting cap bottom lift of claim 12 wherein said container main body, said separate top and said cap have circular top view footprints.

14. The child resistant container with inverting cap bottom lift of claim 12 wherein said cap extends downwardly over said container main body and is friction fitting to said container main body.

15. The child resistant container with inverting cap bottom lift of claim 1 wherein said top is a separate component, said container has a first locking member and said top has a second locking member to permanently connect said top to said main body.

16. The child resistant container with inverting cap bottom lift of claim 15 wherein said container main body, said separate top and said cap have circular top view footprints.

17. The child resistant container with inverting cap bottom lift of claim 15 wherein said cap extends downwardly over said container main body and is friction fitting to said container main body.

18. The child resistant container with inverting cap bottom lift in claim 1 wherein said main body has separate sections, being an upper section and a lower section, and said upper section has a first locking member and said lower section has a second locking member to permanently connect said upper section to said lower section.

19. The child resistant container with inverting cap bottom lift of claim 18 wherein said container main body and said cap have circular top view footprints.

20. The child resistant container with inverting cap bottom lift of claim 18 wherein said cap extends downwardly over said container main body and is friction fitting to said container main body.

* * * * *